United States Patent [19]

Terry et al.

[11] 4,309,821

[45] Jan. 12, 1982

[54] RAZOR

[75] Inventors: John C. Terry; John B. Taylor, both of Reading, England

[73] Assignee: The Gillette Company, Boston, Mass.

[21] Appl. No.: 152,270

[22] Filed: May 22, 1980

[30] Foreign Application Priority Data

May 25, 1979 [GB] United Kingdom ..... 18271/79

[51] Int. Cl.[3] ..... B26B 21/06; B26B 21/52

[52] U.S. Cl. ..... 30/32; 30/85; 206/372; 403/375; 403/380; 220/23.4; D28/46

[58] Field of Search ..... 30/32, 47, 85; 206/370, 206/372, 504, 510; 403/375, 380; 220/23.4; D28/46, 48

[56] References Cited

U.S. PATENT DOCUMENTS

| | | | |
|---|---|---|---|
| 3,070,883 | 1/1963 | Grathwohl | 30/32 |
| 4,212,103 | 7/1980 | Schuman-Hoole | 30/32 |

FOREIGN PATENT DOCUMENTS

| | | | |
|---|---|---|---|
| 2638788 | 3/1977 | Fed. Rep. of Germany | 30/32 |
| 1473527 | 3/1967 | France | 30/32 |
| 1557818 | 12/1979 | United Kingdom | 30/32 |

*Primary Examiner*—Nicholas P. Godici

*Attorney, Agent, or Firm*—Scott R. Foster

[57] ABSTRACT

A disposable razor has its head formed with a rearwardly directed pocket to receive the forward portion of the head of a second razor to its rear, so as to protect the cutting edge or edges of the second razor. The razors are firmly but releasably interengaged with each other by co-operating projections and recess.

5 Claims, 10 Drawing Figures

RAZOR

BACKGROUND OF THE INVENTION

1. Field of the Invention

This invention relates to disposable safety razors, that is to razors in which the blade or blades are permanently mounted in the razor body so that the razor is discarded as a whole when the cutting edge of the (or each) blade has become dulled.

2. Description of the Prior Art

Razors of the type above described are sometimes sold singly and sometimes in packs of two or more, and in the latter case it is desirable to protect the cutting edges of the razor blades for packaging, transit and storage. This is usually achieved by the provision of a removable cover for the head of each razor, typically made as a thermo-formed plastics member, which obviously increases the manufacturing costs of the razors.

SUMMARY OF THE INVENTION

The present invention provides a disposable razor which is designed to permit the razors in a single package to be protected from each other without the use of a separate protective cover.

In accordance with the present invention, there is provided a disposable razor comprising a handle having a transversely extending head at its upper end, the head carrying at least one razor blade having a cutting edge directed forwardly thereof, wherein the razor further comprises releasable coupling means by which two such razors can be firmly but releasably interengaged one behind the other with the head of one razor positioned close to the head of the razor in front of it whereby the cutting edge of the blade of one razor is protected by the head of the other razor.

The razors are thus designed to engage each other in a firm but detachable manner to prevent the protected portion of each razor from coming out of the pocket of the razor in front of it.

The foremost razor in the group will not, of course be protected in the same way and it may have its cutting edge or edges protected by a separate cover, in known manner, or by external packaging, but in any event it cannot be damaged by the other razors in the group, which are held in position behind it.

The above and other features of the invention, including various novel details of construction and combinations of parts, will now be more particularly described with reference to the accompany drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Some forms of disposable razor in accordance with the invention will now be described, by way of example, with reference to the accompanying drawings, in which.

DESCRIPTION OF THE PREFERRED EMBODIMENTS

Figure 1:
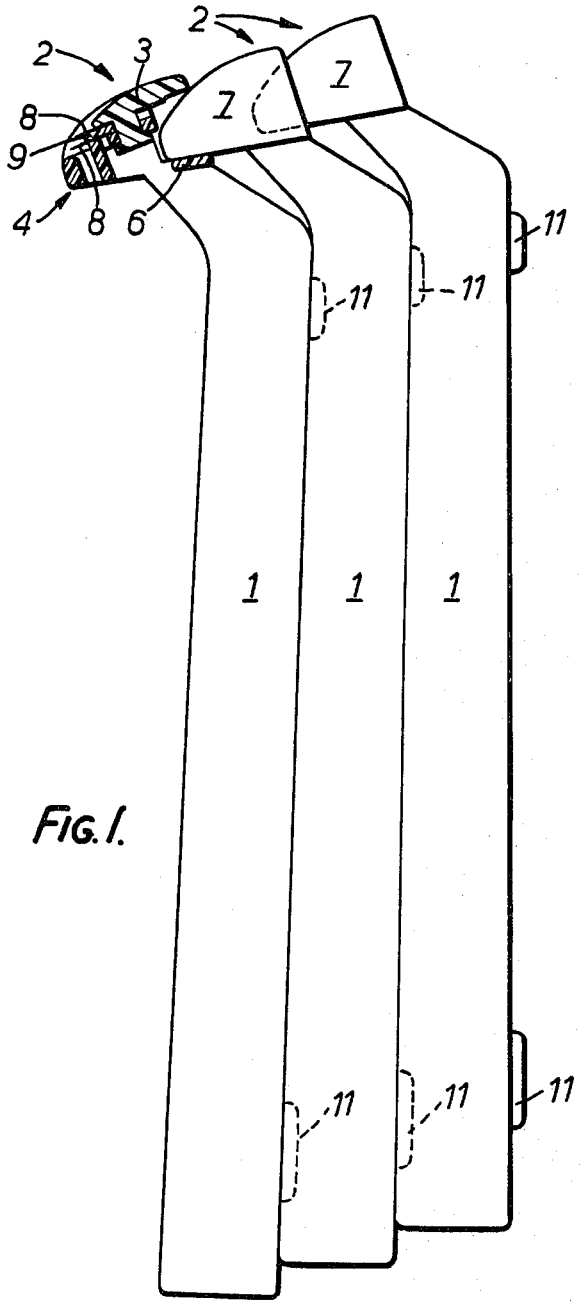
FIG. 1 is a side elevational view, partly sectional, of a group of three razors assembled for packaging and storage and illustrative of an embodiment of the invention.
Figure 2:
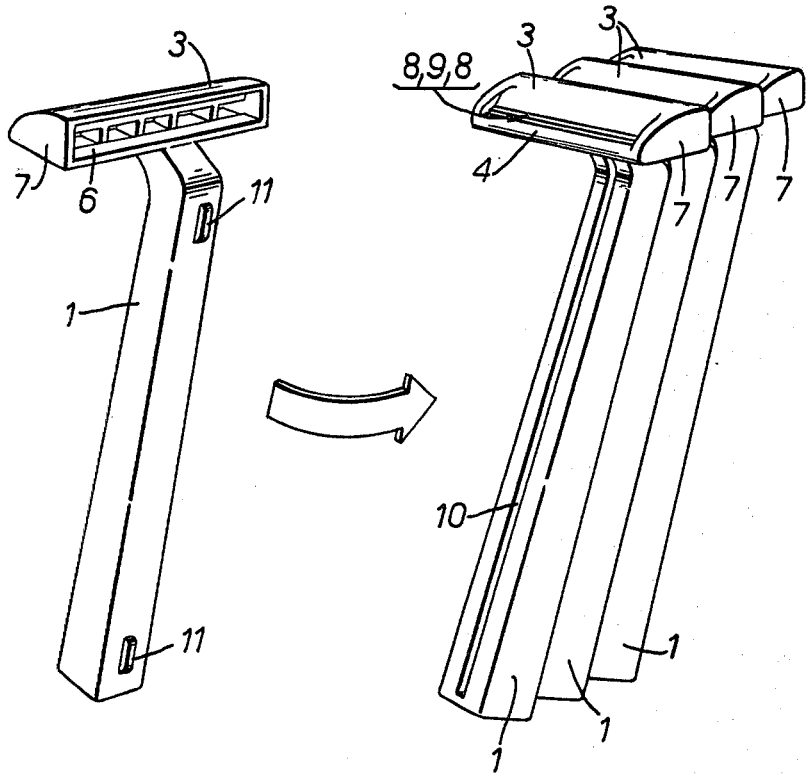
FIG. 2 is a perspective view of the same group of razors and a fourth razor which can be added to the group.
Figure 3:
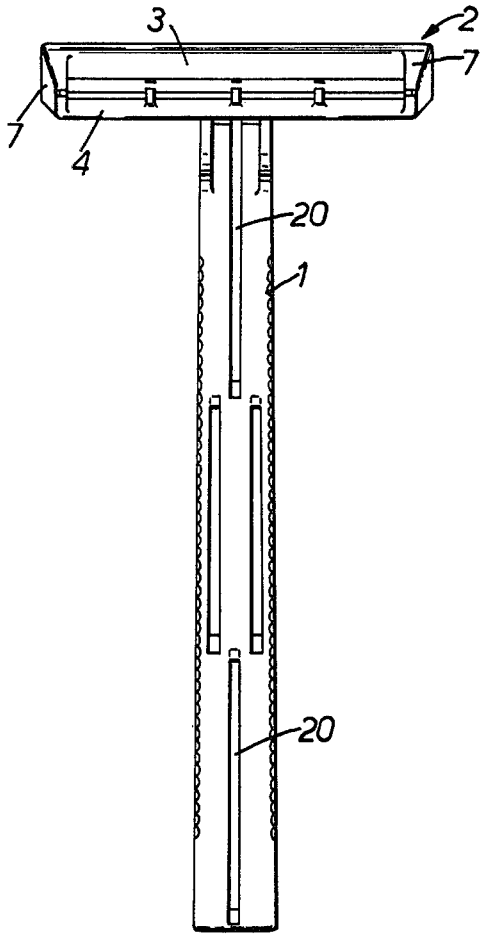
FIGS. 3, 4 and 5 are front, side and rear elevational views of a razor body for a second form of razor, with the blades omitted for clarity.
Figure 4:
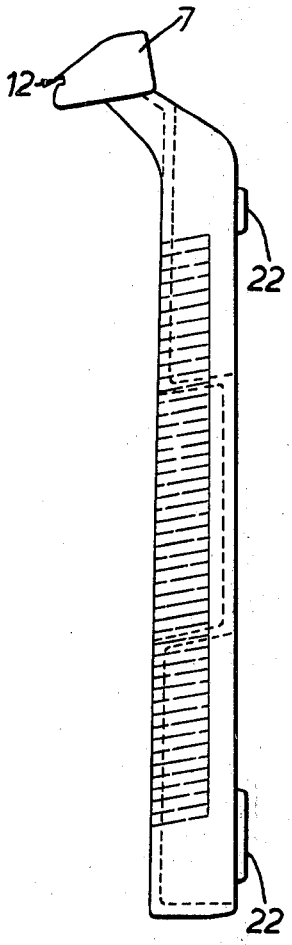
Figure 5:
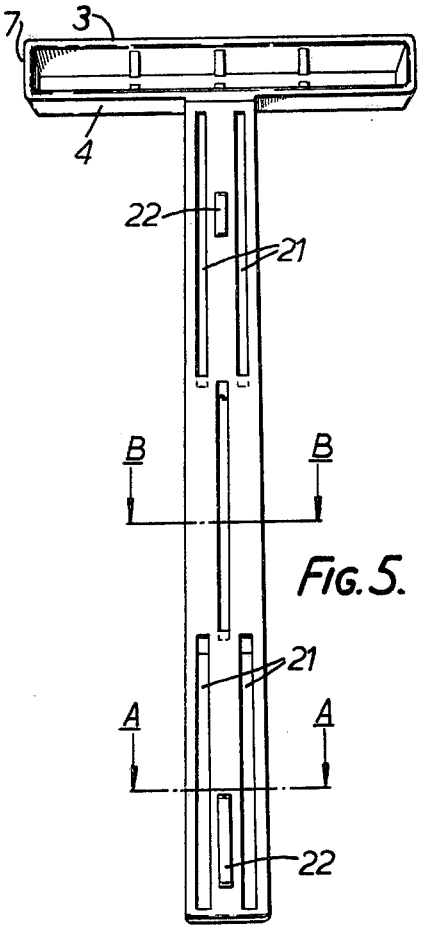
Figure 6:
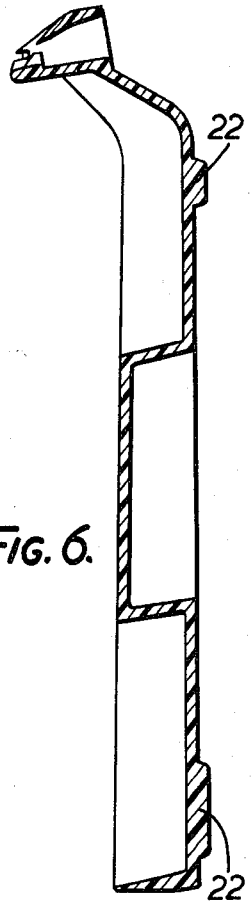
FIG. 6 is a longitudinal section of the razor body.

Each of the razors shown in FIGS. 1 and 2 comprises a plastics moulding formed to provide a handle 1 and a transverse head 2 at one end of the handle. The head comprises a cap portion 3, a guard portion 4 and a rear ledge 6, all generally parallel with, but spaced from each other, and integral at their ends with side walls 7 which diverge rearwardly. A pair of blade members 8 and a spacer 9 are, in this example, secured in the head by integral rivets depending from the underside of the cap portion 3.

The rear face of the handle 1 is formed with at least one but preferably, and as shown, two elongate projections 11 dimensioned to make a firm friction fit in a slot 10 formed in the front face of an adjacent razor handle.

The razors are assembled one in front of another as shown in FIGS. 1 and 2 with the front portion of the second razor head located in a pocket formed by the cap portion 3, ledge 6 and side walls 7 of the head of the first razor, and so on. Thus, the cutting edges of all of the razors in the assembled group, except the first, are protected from damage. The fact that the group of razors forms a coherent assembly also facilitates handling of the razors for packaging.

The razor shown in FIGS. 3 to 8 is designed with a view to simplifying the mould required for its production.

The head 2 of the razor is generally similar to that described above, except that the two blades and spacer are secured to each other to form a separate unit which is mounted in the head by means of lateral projections on the spacer engaging in slots 12 at the front edges of the side walls 7 of the head, which are thereafter permanently deformed to lock the blade and spacer assembly in position. This allows the space beneath the cap portion to be left clear, so that the head can be formed in a simple two part mould without the complication of retractable side pins or the like.

The handle is also designed to facilitate moulding. The handle comprises three distinct sections each of generally W-form, but with the central portion reversed relative to the upper and lower sections. Each section thus comprises four wall portions, of which adjacent pairs are interconnected at the front and rear, alternately.

Figure 7:
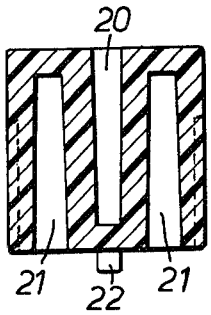
FIGS. 7 and 8 are sections on the lines AA and BB respectively of FIG. 6.
Figure 8:
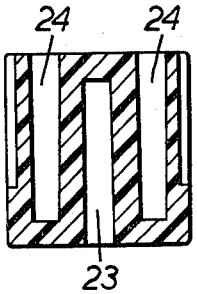

Thus, the upper and lower sections have the form seen in FIG. 7 in which the front face presents a narrow, elongate middle slot 20 and the rear face has a pair of narrow slots 21. A narrow projection 22 is provided at the rear of the section and is dimensioned to make a firm friction fit in the slot 20 of an adjacent razor handle of the same form. In its central section the handle has the cross-section seen in FIG. 8, in which the rear face presents a central narrow slot 23 and the front face has two slots 24.

This configuration, which is believed to be novel in itself, combines substantial weight saving (compared with a solid handle) with a good degree of rigidity.

The razor is particularly well suited to mass production at low cost, both with respect to manufacture of the razors and to assembly of a number of the razors in a group for packaging.

Figure 9:
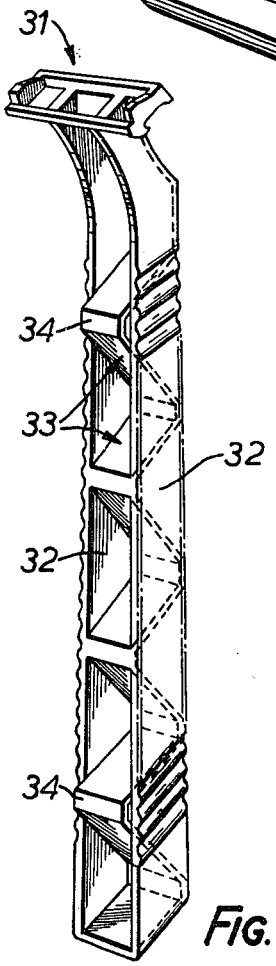
FIG. 9 shows a modified form of handle.

FIG. 9 illustrates an alternative form of handle, formed in this case as a separate moulding to which a suitable razor head is subsequently secured in a permanent manner, for example by use of an adhesive.

The handle has a transverse mounting portion 31 at its upper end to which a head of the general form shown in FIGS. 1 and 2 may be secured. The head could alternatively be of the form shown in FIG. 10 or any other suitable form.

The main portion of the handle comprises a spaced pair of side walls 32 spanned and interconnected by an integral transverse wall 33 of zig-zag form. At spaced positions along the handle, the transverse wall has two portions 34 protruding beyond the adjacent front edges of side walls 32. These portions 34 are of a width to make firm frictional engagement between the side walls of a similar razor placed in front. Alternatively, of course, the protruding portions could be positioned at the rear of the razor handle or at both the front and the rear.

This form of razor handle provides a very good combination of rigidity and weight saving, and at the same time is readily moulded.

Figure 10:
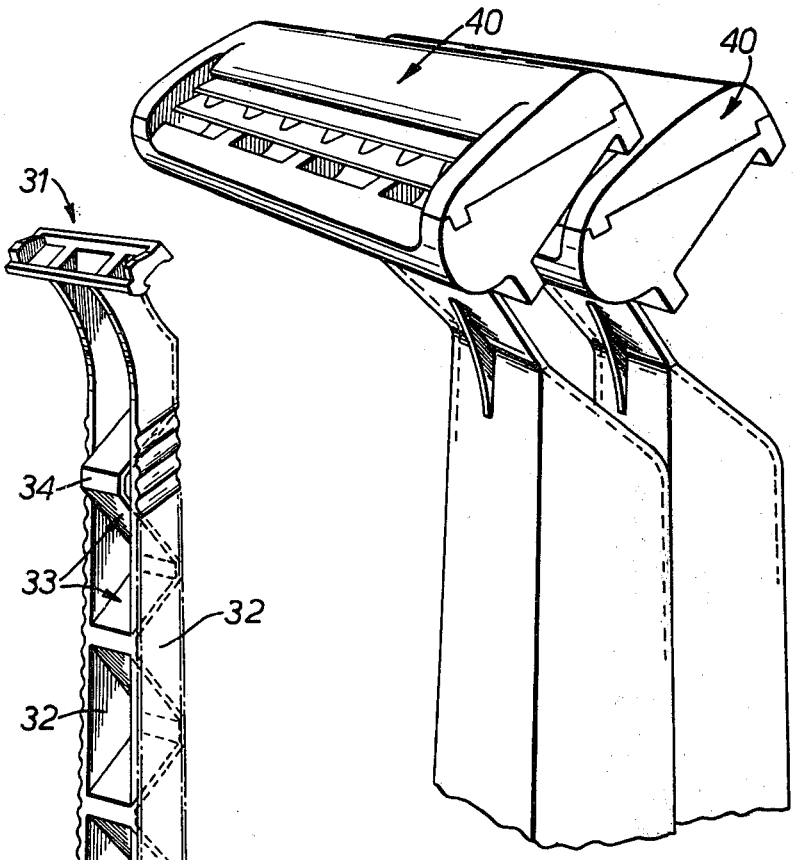
FIG. 10 is a perspective view of an assembled pair of razors illustrating an alternative embodiment.

A further embodiment of the invention is illustrated in FIG. 10, which shows the upper portions only of a pair of frictionally interengaged disposable razors in which the heads 40 do not have true pockets in the sense illustrated in FIGS. 1 and 2, but are so positioned one behind and slightly beneath the other, that the cutting edges of the rear head 40 are shielded by the forward head 40. The heads 40 illustrated by way of example are of the same general form as those replaceable cartridges widely marketed under the names Trac II and GII.

It will be appreciated that heads of this form could be employed with handles of the forms illustrated in FIGS. 1 and 2 or in FIGS. 3 to 8.

We claim:

1. A disposable razor comprising an elongated handle, a transverse head at an end of said handle, said head carrying at least one razor blade having a cutting edge, said head having a cap portion, a guard portion, side walls, and a ledge portion, said cap portion, side walls, and ledge portion defining a pocket open from the rear of said head and dimensioned to receive a forward portion, including said cap portion, cutting edge and guard portion of an identical second razor positioned therebehind, said guard means of said second razor being in engagement with said ledge portion of said head, and releasable coupling means adapted to permit firm but releasable engagement of said razors, one behind the other in relative positions in which said head of one said razor is positioned to shield said cutting razor blade edge of said second razor.

2. A disposable razor as claimed in claim 1, wherein said coupling means comprises respective complementary recess and projection means formed on said handle.

3. A disposable razor as claimed in claim 2, wherein said handle comprises respective upper, lower and intermediate sections, each having a cross-section which is substantially rectangular in outline and comprises four substantially parallel wall portions extending fore and aft of said handle and transverse wall portions interconnecting adjacent pairs of said wall portions at the front and rear, alternately of said handle, whereby to define three slots of which the central slot is directed oppositely to the slots on either side, and wherein said cross-section of said intermediate section is reversed relative to the cross-section of said upper and lower sections.

4. A disposable razor as claimed in claim 3, comprising a plurality of projections each positioned and dimensioned to make frictional engagement with a respective one of said slots of an adjacent razor handle of the same form.

5. A disposable razor comprising an elongate handle, a transverse head at one end of said handle, blade means disposed in said head and having cutting edge means thereon, said handle having a pair of spaced side walls and a transverse wall spanning said side walls, said transverse wall having a zig-zag configuration defining a plurality of protuberances at spaced points along said handle, said protuberances being positioned and dimensioned to make frictional engagement between said side walls of an adjacent razor of the same form, such frictional engagement means comprising releasable coupling means adapted to permit releasable engagement of said razors, one behind the other in relative positions in which said head of one said razor is positioned to shield said cutting edge means of the other said razor.

* * * * *